US007327210B2

(12) United States Patent
Blair et al.

(10) Patent No.: US 7,327,210 B2
(45) Date of Patent: Feb. 5, 2008

(54) BAND AGILE FILTER

(75) Inventors: Bill Blair, Freehold, NJ (US); Jeff Blair, Freehold, NJ (US); Bill Engst, Marlboro, NJ (US); Robert Laemmle, Freehold, NJ (US); Greg Lamont, Jackson, NJ (US); Weili Wang, Rocky Hill, CT (US); William Wilber, Southbury, CT (US)

(73) Assignee: Radio Frequency Systems, Inc., Meriden, CT (US)

( * ) Notice: Subject to any disclaimer, the term of this patent is extended or adjusted under 35 U.S.C. 154(b) by 173 days.

(21) Appl. No.: 10/866,789

(22) Filed: Jun. 15, 2004

(65) Prior Publication Data

US 2005/0275488 A1 Dec. 15, 2005

(51) Int. Cl.
*H01P 7/00* (2006.01)
*H01P 7/04* (2006.01)
*H01P 7/06* (2006.01)

(52) U.S. Cl. ..... 333/202; 333/219; 333/222; 333/223; 333/227; 333/231

(58) Field of Classification Search ..... 333/219, 333/222, 223, 227, 231
See application file for complete search history.

(56) References Cited

U.S. PATENT DOCUMENTS 4,028,652 A 6/1977 Wakino et al.
4,342,972 A 8/1982 Nishikawa et al.
4,385,279 A 5/1983 Meador
4,437,076 A * 3/1984 Makimoto et al. ..... 333/206
4,523,162 A 6/1985 Johnson
4,622,528 A 11/1986 Milard
4,757,288 A 7/1988 West
5,055,808 A 10/1991 Walker et al.
5,065,120 A 11/1991 Munn
5,065,121 A 11/1991 Ghadaksaz
6,097,263 A 8/2000 Mueller et al.
6,317,017 B1 * 11/2001 Takenaka ..... 333/235
6,549,097 B2 4/2003 Guillon et al.
6,882,246 B2 * 4/2005 Marquardt et al. ..... 333/174
2003/0117241 A1 6/2003 Engst

* cited by examiner

*Primary Examiner*—Robert Pascal
*Assistant Examiner*—Kimberly E Glenn
(74) *Attorney, Agent, or Firm*—TTom Gellenthien

(57) ABSTRACT

A microwave filter and method for remotely tuning a microwave filter from one sub-band to another sub-band using metallic rings to adjust the capacitance or inductance of the resonator. In adjusting the capacitance, a plurality of metallic rings are disposed in the upper section or end of the resonator. Each ring has an RF switch that connects or disconnects each ring to ground, thereby varying the capacitance of the resonator. In adjusting the inductance, a plurality of metallic rings are disposed perpendicular to the magnetic field of the resonator. Each ring has an RF switch disposed within the electrical path of the ring that opens or closes the electrical path of each ring. By opening and closing each ring, the magnetic field of the resonator is altered, thereby varying the inductance of the resonator.

56 Claims, 9 Drawing Sheets

BAND AGILE FILTER

FIELD OF THE INVENTION

The present invention relates to microwave filters, and more particularly relates to bandwidth agile filters used in cellular telephone communication systems that can be remotely tuned to different sub-bands.

BACKGROUND OF THE INVENTION

Often, a microwave filter in a cellular telephone base station is required to transmit only a certain fraction of the bandwidth for a given communication system. For example, if the receive bandwidth for a given communication system is 1850-1910 MHz, the microwave filter may be required to transmit only a certain 20 MHz sub-band (i.e. 1870-1890 MHz). Additionally, a given communication system may require the ability to switch or change between different sub-bands. As a result, the filter needs to have the ability to tune to another sub-band. It is desirable for the filter to be adjustable remotely. In other words, it is desirable to be able to adjust or tune the filter to different sub-bands without having to send a technician into the field to manually or mechanically adjust or tune the filter.

Typically, a microwave filter is tuned by adjusting the resonant frequency of the resonator. Currently, the resonators are tuned by using a metal material to selectively disrupt the electromagnetic energy distribution in the resonator. This is typically accomplished by manually or mechanically turning a tuning screw in the resonator. There is typically one tuning screw per resonator, and a plurality of resonators per filter.

However, manually or mechanically turning the tuning screws in the resonator creates a number of problems. First, manually tuning, by definition, cannot be done remotely. This requires a technician to travel to the base station to tune the resonator. Second, mechanically tuning creates mechanical problems because a number of moving parts may be required, such as a motor to turn the screws. The motors are prone to mechanical failure. Third, although mechanically turning screws and thereby adjusting the resonant frequency of the resonator is possible remotely, it is relatively expensive to implement.

Based on the above problems, it is desirable to have a remotely adjustable microwave filter that is reliable, accurate and inexpensive.

SUMMARY OF THE INVENTION

The present invention remotely adjusts the sub-band of the microwave filter by remotely adjusting the resonator frequency. The resonator frequency is changed by adjusting either the capacitance or inductance of the resonator. To adjust the capacitance of the resonator, a capacitance adjusting device is added to the upper cavity of the resonator. The microwave adjusting device comprises a plurality of metallic rings, each connected to ground through an RF switch. The RF switches can be remotely switched to selectively connect or disconnect each metallic ring to ground. By grounding the metallic rings, the capacitance of the resonator is increased and the resonant frequency decreases. By varying the size, shape and number of metallic rings, the microwave filter can be remotely tuned from one sub-band to another without the expense and problems caused by excessive mechanical components.

Similarly, the microwave filter can be tuned to different sub-bands by selectively altering the inductance of the resonator. In this embodiment, an inductance adjusting device is place around the resonator, within the cavity of the resonator. The inductance adjusting device contains a plurality of metallic rings. Each metallic ring contains an RF switch within the electrical path of the metallic ring. The RF switch is operable to open or close the electric path of the metallic ring. When the electrical path of the metallic ring is open, the metallic rings have substantially no effect of the resonant frequency. However, when the electrical path of the metallic ring is closed, the inductance of the resonator is decreased and the resonant frequency is increased. Like the capacitive adjusting method, the size, shape, distance to the resonator, orientation and number of metallic rings will determine the magnitude of the frequency change.

Further objects, features and advantages of the invention will become apparent from a consideration of the following description and the appended claims when taken in connection with the accompanying drawings.

BRIEF DESCRIPTION OF THE DRAWINGS

The above aspects of the present invention will become more apparent by describing in detail embodiments thereof with reference to the attached drawings, in which:

FIG. 5(*b*) is a perspective view of a capacitance adjusting device of an embodiment of the present invention;

FIG. 5(*c*) is a perspective view of a capacitance adjusting device of an embodiment of the present invention;

DETAILED DESCRIPTION OF THE INVENTION

Hereinafter, embodiments of the present invention will be described in detail with reference to the attached drawings. The present invention is not restricted to the following embodiments, and many variations are possible within the spirit and scope of the present invention. The embodiments of the present invention are provided in order to more completely explain the present invention to one skilled in the art.

Figure 1:
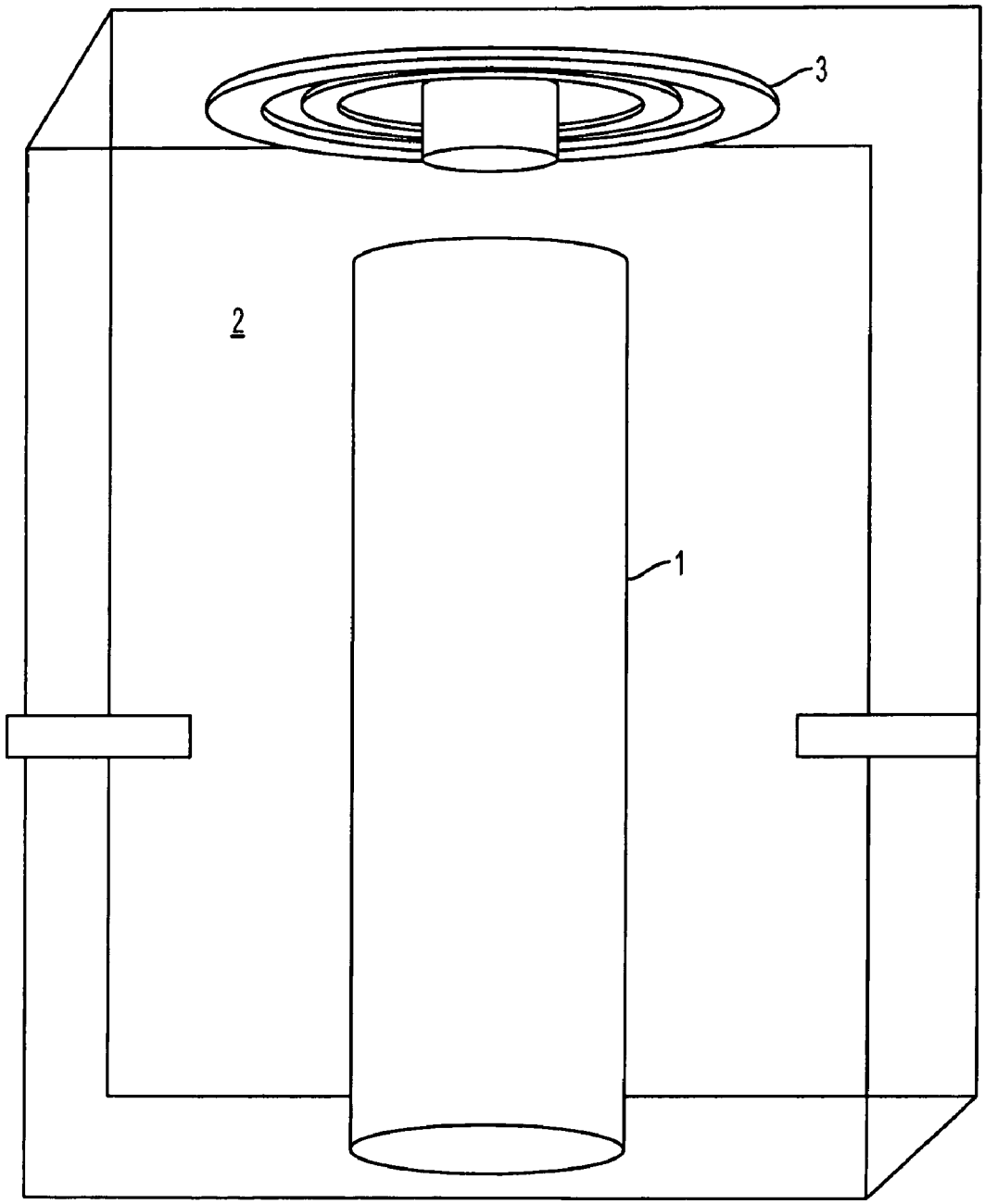
FIG. 1 is a perspective view of a metallic coaxial resonator having a capacitance adjusting device of an embodiment of the present invention.

Referring to FIG. 1, a metallic coaxial resonator 1 is shown. The ability to tune a microwave filter from one sub-band to another requires that the resonant frequency of each individual resonator in the filter be tuned. In order to tune the resonator frequency, the capacitance or inductance of each resonator must be changed. FIG. 1 shows a capacitance adjusting device having the ability to change the resonant frequency by altering the capacitance of the resonator.

The embodiment of FIG. 1 uses a plurality of electrically conductive rings 3 disposed in the upper part of cavity 2 of the resonator 1. To change the capacitance of the resonator, the electrically conductive rings 3 are selectively connected to ground. By grounding the rings 3, capacitance is increased which in turn lowers the resonant frequency. If the rings 3 are not grounded (i.e. floating electrically), then the resonant frequency is not significantly changed by the addition of the rings 3.

The number of rings 3, their shape, position and size will be determined by the number of sub-bands, the frequency shift required, and the dimensions of the resonator cavity 2. For example, in FIG. 1, the rings 3 are concentric about the tuning screw of the resonator and circular in shape. However, based on the operational parameters of the filter, the size, shape and position of the rings 3 may be changed. If required, the rings 3 may be different in size (diameter, thickness, width . . . ) and/or shape.

Figure 2:
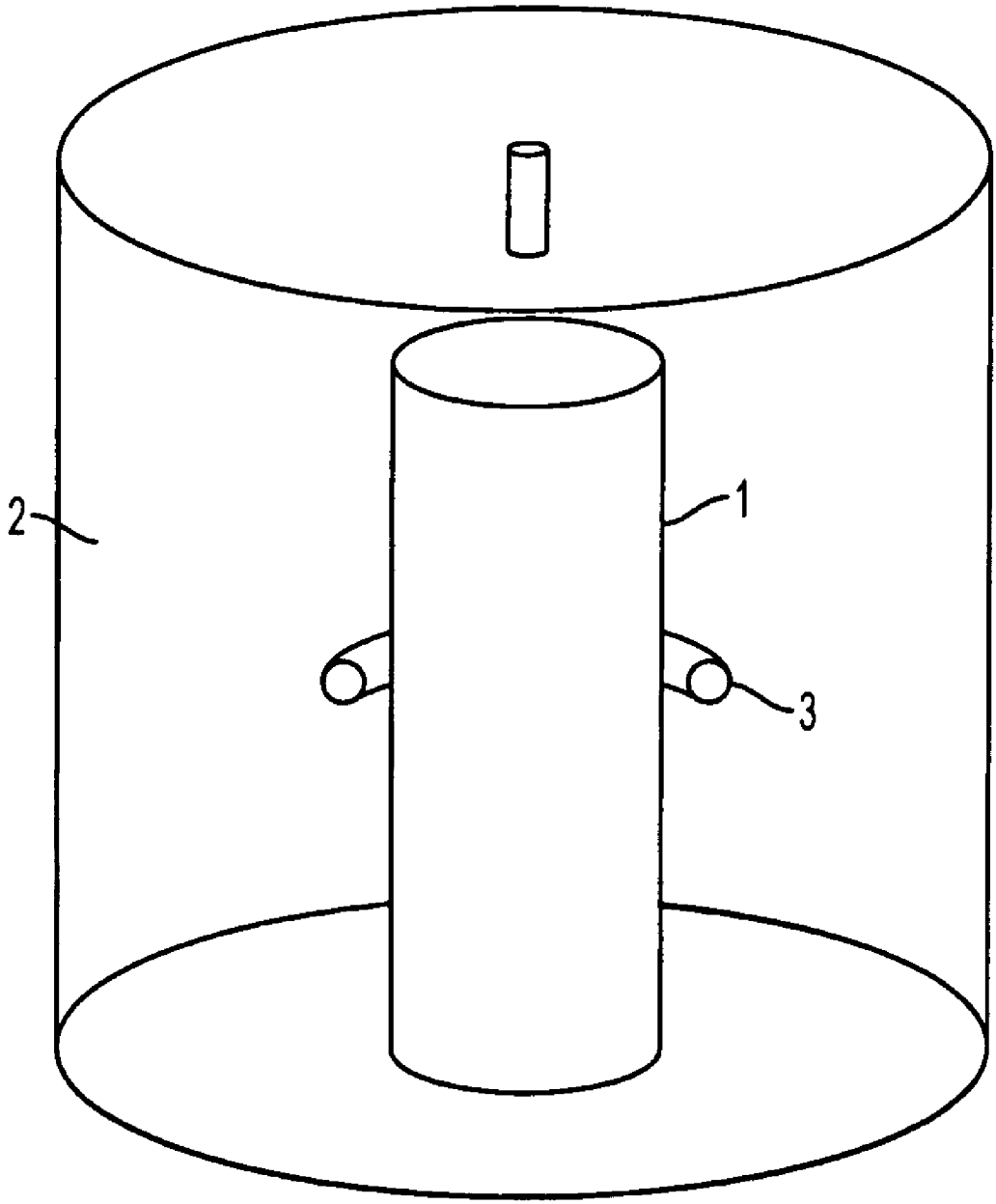
FIG. 2 is a perspective view of the metallic coaxial resonator having an inductance adjusting device of an embodiment of the present invention

FIG. 2 shows an embodiment of an inductance adjusting device in which the inductance of the resonator 1 is altered instead of altering the capacitance of the resonator 1. As shown in FIG. 2, electrically conductive rings 3 are disposed around the metallic coaxial resonator 1, in the cavity 2 that surrounds the resonator 1. The ring face is disposed to be essentially perpendicular to the magnetic field of the resonator 1. Unlike the capacitance adjusting device of FIG. 1, the rings 3 of the inductance adjusting device shown in FIG. 2 are, preferably, disposed more towards the lower section of the resonator cavity 2. Also, the rings 3 of the inductance adjusting device operate differently than the rings 3 of the capacitance adjusting device. The rings 3 of the inductance adjusting device are operable to open and close the electrical path of the ring 3. Said differently, each ring 3 contains a switch which opens or closes the electrical path of the ring. When the electrical paths of the rings 3 are open (i.e. not electrically continuous), the rings 3 have very little effect on the inductance and as a result, the rings have very little effect on the resonant frequency. However, when the electrical paths of the rings 3 are closed (i.e. electrically continuous), the inductance is lowered and the resonant frequency is shifted higher.

Like the capacitance adjusting rings 3 of FIG. 1, the magnitude of the frequency change in the inductive adjusting rings 3 of FIG. 2 will be determined by the number of rings 3, the size, shape, orientation and position of the rings 3. For example, larger rings 3 would realize a greater frequency shift than smaller rings 3. Similarly, rings 3 that are positioned closer to the resonator 1 or closer to the bottom of the resonator cavity 2 will realize a greater frequency shift than rings 3 that are positioned closer to the middle of the resonator 1.

Figure 3:
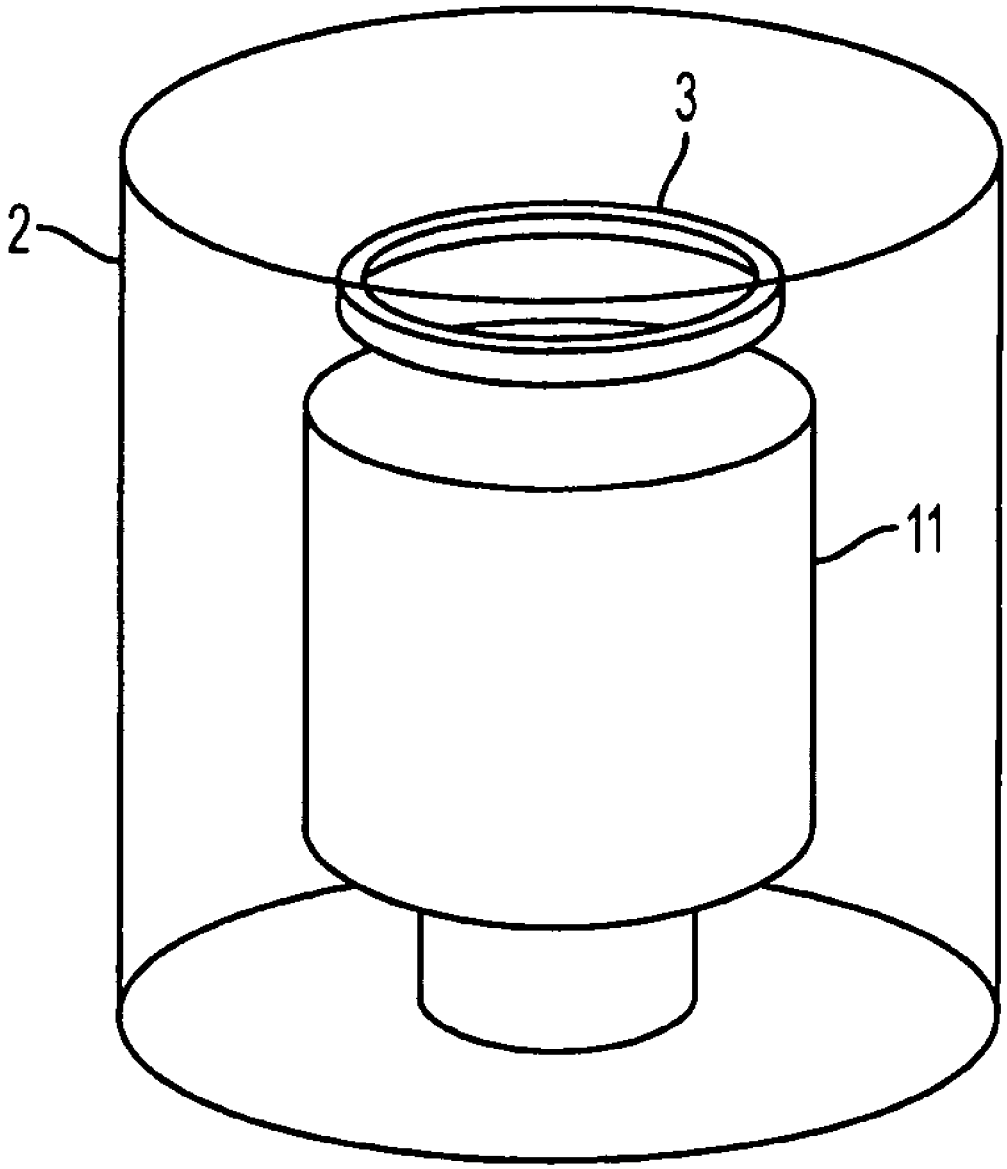
FIG. 3 is a perspective view of a dielectric-loaded resonator having an inductance adjusting device of an embodiment of the present invention.
Figure 4:
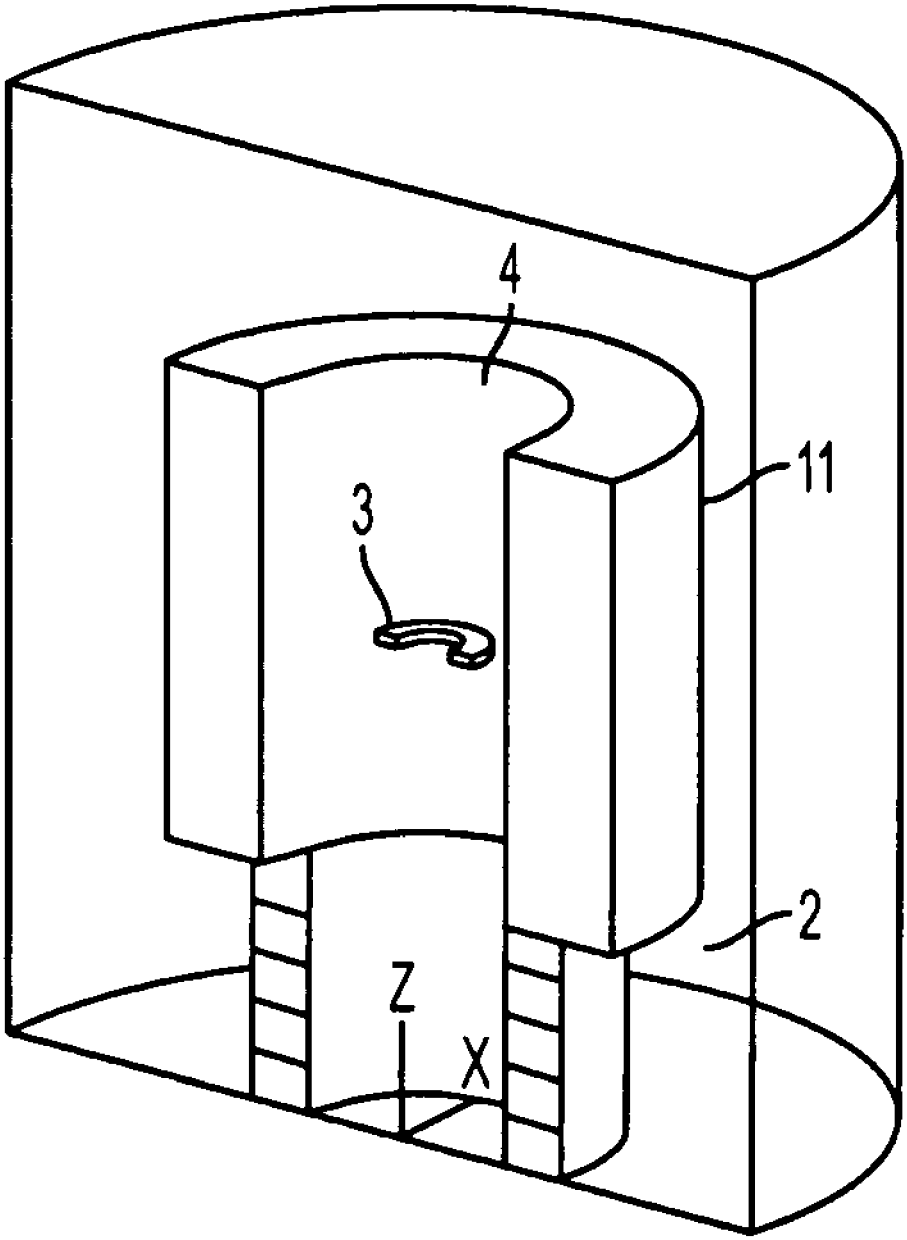
FIG. 4 is a perspective view of a dielectric-loaded resonator having an inductance adjusting device of an embodiment of the present invention.

FIGS. 3 and 4 show examples of rings 3 used to change the resonant frequency of a dielectric-loaded resonator 11 by varying the inductance of the resonator 11. In FIG. 3, a single electrically conductive ring 3 is disposed in the upper part of cavity 2 of the resonator 11. In FIG. 4, a single ring 3 is disposed in an inner cavity 4 of the dielectric-loaded resonator 11. However, more than one ring 3 may be used and the rings 3 may be oriented and positioned at different locations within the resonator cavity 2. Like the inductance adjusting device of FIG. 2, the number, size, shape, orientation and position of the rings 3 can independently vary depending on the operational requirements of the filter. The resonant frequency of the dielectric resonator is changed by having the ring electrically open (non-continuous) or closed (electrically continuous). If the ring is open, the ring will have very little effect on the resonant frequency of the cavity. If the ring is closed, the inductance will change and the resonant frequency of the cavity will increase.

Also, the ring face is disposed essentially perpendicular to the magnetic field of the resonator 11. However, the inductance, and as a result resonant frequency, can be changed solely by changing the orientation of the ring face with respect to the magnetic field. For example, in a metallic coaxial resonator 1, the rings 3 can be mounted on a dielectric rod 12 that protrudes to the outside of the cavity 2 and can be rotated manually, or using a solenoid or motor.

In FIGS. 1-4, the rings 3 are shown as suspended within the resonator cavity 2 simply for the purpose of simplifying the understanding of the present invention. However, in practice the rings 3 are not suspended within the resonator cavity 2. Instead, the rings 3 are formed on a printed circuit board 5 (FIG. 6) or formed as discrete elements that are held in place or suspended by any type of insulating material. For example, the insulating material could be any type of commonly used insulator used in RF/microwave applications, such as Teflon, Rexolite, or polystyrene.

Figure 5A:
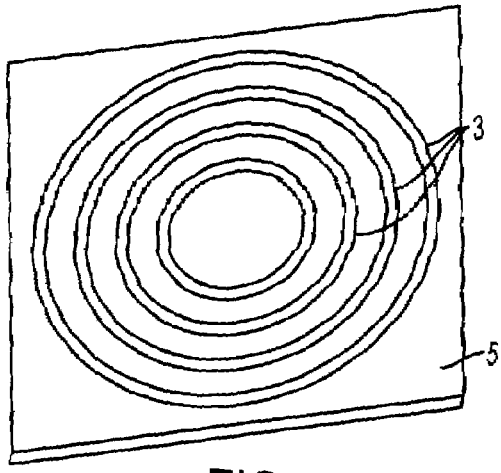
FIG. 5(*a*) is a perspective view of a capacitance adjusting device of an embodiment of the present invention.
Figure 5B:
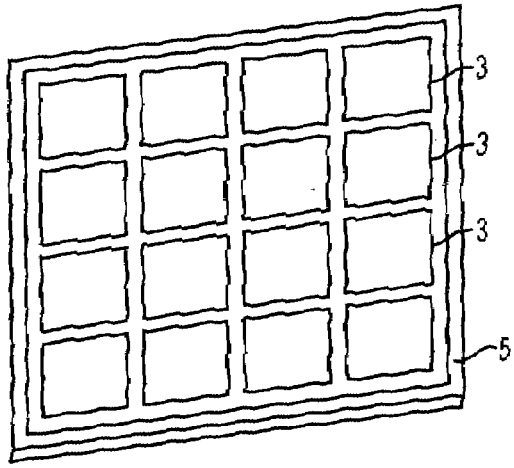
Figure 5C:
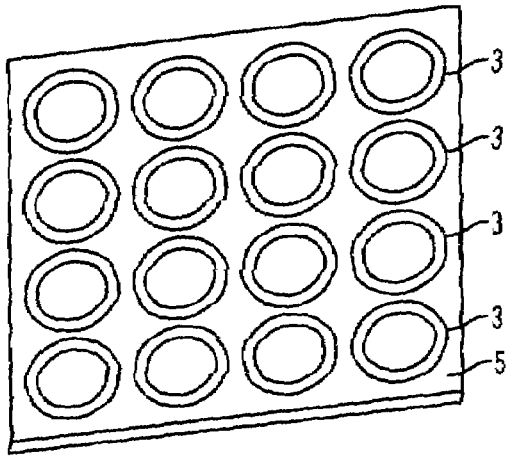

FIGS. 5(*a*)-(*c*) show examples of different geometries for multiple rings 3 patterned on a printed circuit board 5. Specifically, FIG. 5(*a*) shows a printed circuit board 5 having concentric circular rings 3. FIG. 5(*b*) shows a printed circuit board having a non-concentric contiguous grid of square rings 3, while FIG. 5(*c*) shows a non-concentric array of discrete circular rings 3 having substantially the same size patterned on a printed circuit board 5. FIGS. 5(*a*)-(*c*) are only examples meant to help illustrate the present invention. In no way are the examples of FIGS. 5(*a*)-(*c*) meant to limit the scope of the present invention. As is well understood, many different combinations of number, size, shape and position of the rings 3 may be used within the spirit of the present invention.

Figure 6:
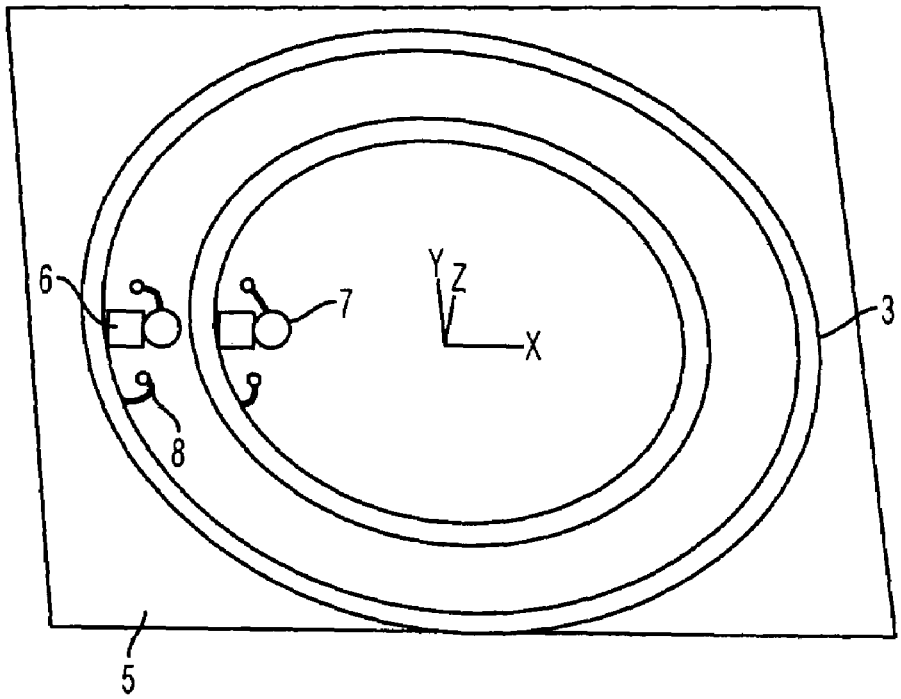
FIG. 6 is a perspective view of a capacitance adjusting device of an embodiment of the present invention.
Figure 7:
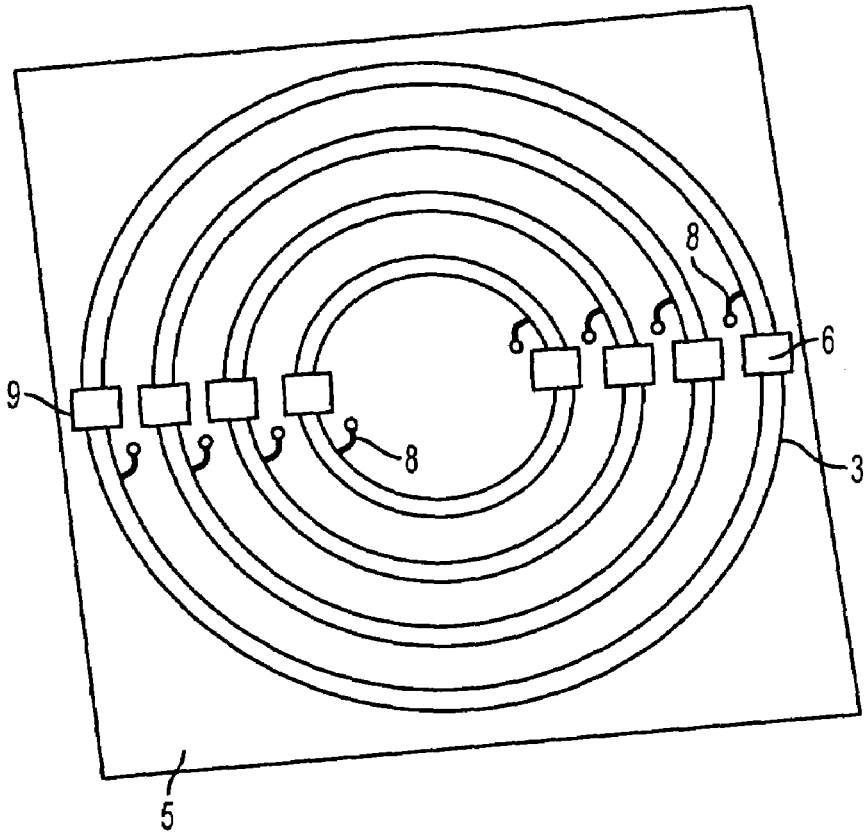
FIG. 7 is a perspective view of an inductance adjusting device of an embodiment of the present invention.

Referring to FIGS. 6 and 7, in order to remotely adjust the capacitance or inductance of the resonator, RF switches 6 are used in both the capacitance and inductance adjusting devices. Possible types of RF switches 6 that can be used includes, but is not limited to, PIN diodes, MEMS, RF transistors, voltage-tunable capacitor, mechanical relays, mechanical switches, and piezo-electric actuator. However, the location and purpose of the RF switches 6 differ significantly depending on whether the capacitance or inductance is to be adjusted. For example, in the capacitance adjusting device of FIG. 1, an RF switch 6 is positioned between each ring 3 and electrical ground in order to allow each ring 3 to be selectively connected and disconnected to ground 7. Conversely, in the inductance adjusting devices of FIGS. 2-4, an RF switch 6 is placed within the electrical path of the ring 3 in order to selectively open and close the electrical path of each ring 3. Implementation of the RF switches 6 will be explained further with reference to FIGS. 6 and 7.

FIG. 6 shows an embodiment of a capacitance adjusting device having two concentric electrically conductive rings 3 patterned on a printed circuit board 5. Each ring 3 is electrically connected to ground 7 through an RF switch 6. The RF switch 6 has two electrical leads 8 for the DC control signals. Each ring 3 is closed (i.e. electrically continuous) and can be grounded when the RF switch 6 connects the ring 3 to ground 7. The electrical leads 8 can be separate wires or part of the printed circuit board 5.

FIG. 7 shows an embodiment of an inductance adjusting device having four concentric electrically conductive rings 3 patterned on a printed circuit board 5. Each ring 3 has an RF switch 6 disposed within the electrical path of the ring 3. The RF switch 6 operates to electrically open and close the electrical path of the ring 3. Like the RF switches 6 of FIG. 6, each RF switch 6 has two electrical leads 8 for the DC control signals. The DC control signals will operate each switch. Since the RF switch 6 is an integral part of the electrical path of the ring 3, there must be some type of element that will electrically isolate the two DC connections 8 on the ring 3 from each other. In FIG. 7, a capacitor 9 is disposed in the electrical path of the ring 3. By appropriately choosing the capacitance value of the capacitor 9, the two DC signals will be isolated from each other while the RF current in the ring 3 will not be affected. As with the capacitance adjusting device, the DC connections 8 can be either separate wires or part of the printed circuit board 5. Furthermore, the DC connections may also require an inductive element in series in order to prevent RF current from flowing along the DC circuit.

Figure 8:
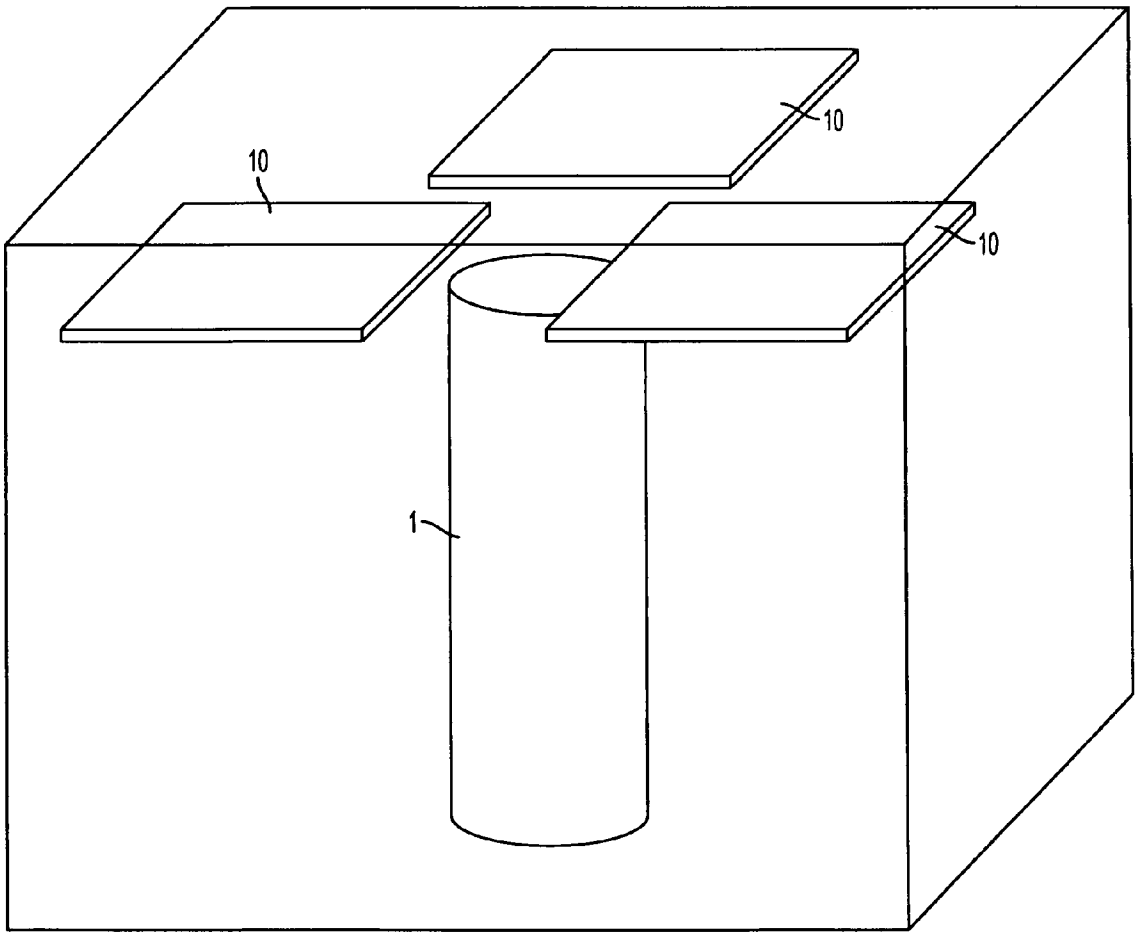
FIG. 8 is a perspective view of a metallic coaxial resonator having a capacitance adjusting device of an embodiment of the present invention.

Until now, the above examples of capacitance adjusting devices have all used some variation of connecting and disconnecting electrically conductive rings 3 to alter or change the capacitance of a resonator 1. However, the present invention is not limited to capacitance adjusting devices that use electrically conductive rings 3. For example, FIG. 8 shows another embodiment of a capacitance adjusting device which uses a plurality of metallic plates 10 instead of rings 3. In this embodiment, similar to the embodiments using rings 3, an RF switch 6 is used to selectively connect and disconnect the metallic plates 10 to ground. The RF switches 6 are disposed between each metallic plate 10 and ground. Furthermore, the RF switches 6 can be connected via separate wires or as part of a printed circuit board 5. Regardless, the operation remains essentially the same. The number, size, shape and position of the plates 10, each characteristic of which is independently variable, will determine the magnitude of frequency change that is realized. Like the grounding of the rings 3, the grounding of the plates 10 adds capacitance to the resonator 1 and lowers the resonant frequency.

Although three square plates shown in FIG. 8 are disposed in the same horizontal plane, the number, size, shape, angular orientation and position of plates 10 can vary. Similarly, the plates do not need to be in the same plane. Additionally, the metal plates 10 can be held in place within the resonator cavity by any type of insulating material.

In operation, the microwave filter will initially be set to a desired sub-band and the geometry of the microwave filter adjusting device will be set based on the required operation parameters of the microwave filter. For example, initially, the microwave filter may be set to operate at a sub-band of 1850-1870 MHz and the operational parameters may dictate that the filter will need to be capable of adjusting to different sub-bands at increments of 20 MHz from 1800-1900 MHz. The number, size, shape and position of the rings 3 or plates 10 will then be selected to be operable to shift the resonant frequency at intervals of 20 MHz from 1800-1900 MHz. During operation, when requested, the microwave filter may be remotely tuned to another sub-band by sending control signals to the microwave filter to selectively operate the RF switches 6, which in turn change the resonant frequency and sub-band. For example, if the microwave filter contains a capacitance adjusting device, the RF switches 6 will selectively ground or float an appropriate number of rings 3 to tune the filter to the desired sub-band.

Figure 9:
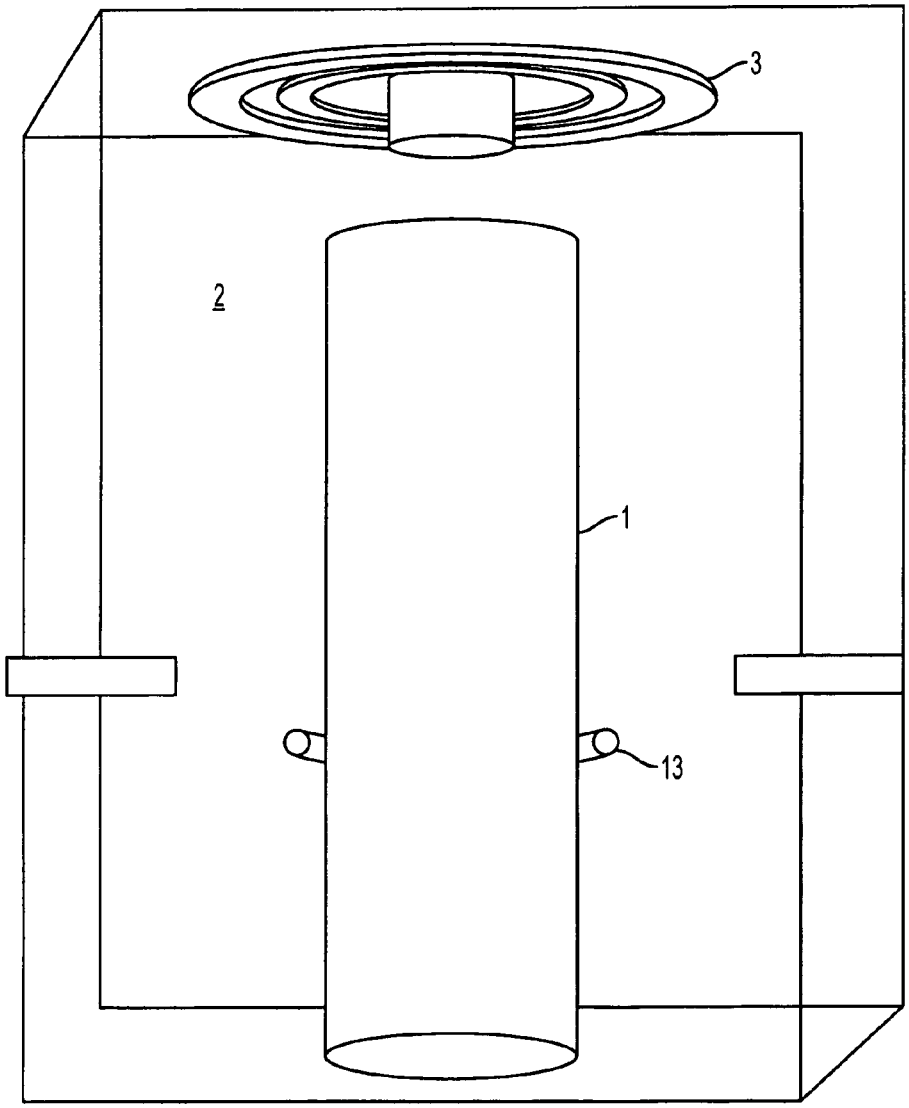
FIG. 9 is a perspective view of a filter having a capacitance and an inductance adjusting device.

It should be noted that the capacitance and inductance adjusting devices have been explained above separately. However, a single microwave filter may use both the capacitance and inductance adjusting devices as shown in FIG. 9. In such a case, the capacitance adjusting device would ideally be disposed in the upper section of the resonator cavity 2 while the inductance adjusting device 13 would be disposed in the lower section of the resonator cavity 2 as described above. Also, the above described tuning filter can be used in combiners as well.

The above described filters can be implemented in a base station of a communication system and automatically (and remotely) adapted to meet several different electrical specifications. In other words, a base station can be built having any type of filter described above before the required sub-band is known. By having such a filter installed, the required sub-band can be subsequently tuned to meet the required specifications. This is accomplished in a preferred embodiment by sending a computer controlled signal from the base station manufacturer to the filter. The computer controlled signal will control the switching elements found within the filter. Accordingly, the filter can be tuned by sending computer controlled signals that selectively open or close the RF switches associated with the filter or filters. Additionally, the computer controlled signal will control the motors used to rotate or reposition the rings within the filter cavity if the filter provides such capability.

While this embodiment uses computer controlled signals to tune the filter to the required specifications, the present invention is not limited to such an implementation. For example, the switches can be controlled manually by an operator at the direction of a remotely located technician.

The above description of the preferred embodiments has been given by way of example. From the disclosure given, those skilled in the art will not only understand the present invention and its attendant advantages, but will also find apparent various changes and modifications to the structures and methods disclosed. It is sought, therefore, to cover all such changes and modifications as fall within the spirit and scope of the invention, as defined by the appended claims, and equivalents thereof.

What is claimed is:

1. A microwave filter comprising:

a resonator; and a capacitance adjusting device, wherein said capacitance adjusting device comprises:

at least one electrically conductive ring disposed in an upper region of a cavity of said resonator;

an RF switch corresponding to each of said at least one electrically conductive ring;

wherein each said RF switch is disposed between ground and said corresponding electrically conductive ring; and wherein each said RF switch is operable to electrically connect and disconnect each said corresponding electrically conductive ring to ground.

2. The microwave filter of claim 1, wherein said at least one electrically conductive ring comprises a plurality of concentric electrically conductive rings, each of said plurality of concentric electrically conductive rings having a different diameter.

3. The microwave filter of claim 1, wherein said at least one electrically conductive ring comprises a plurality of non-concentric electrically conductive rings.

4. The microwave filter of claim 1, wherein said at least one electrically conductive ring is formed on a printed circuit board.

5. The microwave filter of claim 1, wherein said at least one electrically conductive ring is suspended in an insulating material.

6. The microwave filter of claim 1, wherein said RF switch is a mechanical relay.

7. The microwave filter of claim 1, wherein said RF switch is selected from the group consisting of PIN diodes, MEMS, RF transistors, voltage-tunable capacitor, mechanical relays, mechanical switches and piezo-electric actuator.

8. The microwave filter of claim 1, wherein said microwave filter further comprises:

an inductance adjusting device, wherein said inductance adjusting device further comprises:

at least one electrically conductive ring disposed around said resonator;

an RF switch corresponding to each of said at least one electrically conductive ring;

wherein each said RF switch is disposed within an electrical path of said corresponding electrically conductive ring; and wherein each said RF switch is operable to electrically open and close each electrical path of said corresponding electrically conductive ring.

9. A microwave filter comprising:

a resonator; and a capacitance adjusting device, wherein said capacitance adjusting device comprises:

at least one metallic plate disposed in an upper region of a cavity of said resonator; and an RF switch corresponding to each of said at least one metallic plate;

wherein each said RF switch is disposed between ground and each said corresponding metallic plate; and wherein each said RF switch is operable to electrically connect and disconnect each said corresponding metallic plate to ground.

10. The microwave filter of claim 9, wherein said at least one metallic plate comprises a plurality of metallic plates; and wherein said metallic plates are disposed in the same horizontal plane within said upper region of said cavity.

11. The microwave filter of claim 9, wherein said RF switch is a mechanical relay.

12. The microwave filter of claim 9, wherein said RF switch is selected from the group consisting of PIN diodes, MEMS, RF transistors, voltage-tunable capacitor, mechanical relays, mechanical switches and piezo-electric actuator.

13. The microwave filter of claim 9, wherein said at least one metallic plate is formed on a printed circuit board.

14. The microwave filter of claim 9, wherein said at least one metallic plate is suspended in an insulating material.

15. The microwave filter of claim 9, wherein said microwave filter further comprises:

an inductance adjusting device, wherein said inductance adjusting device further comprises:

at least one electrically conductive ring disposed around said resonator;

an RF switch corresponding to each of said at least one electrically conductive ring;

wherein each said RF switch is disposed within an electrical path of said corresponding electrically conductive ring; and wherein each said RF switch is operable to electrically open and close each electrical path of said corresponding electrically conductive ring.

16. A method of adjusting a microwave filter from one sub-band to another sub-band comprising the steps of:

placing at least one electrically conductive ring in an upper region of a cavity of a resonator, wherein an RF switch is disposed between each said electrically conductive ring and ground, and selectively switching said RF switches to electrically connect and disconnect said at least one electrically conductive rings to ground.

17. The method of adjusting a microwave filter from one sub-band to another sub-band of claim 16, wherein said electrically conductive rings are concentric and each said ring having a different diameter.

18. The method of adjusting a microwave filter from one sub-band to another sub-band of claim 16, wherein said electrically conductive rings are non-concentric.

19. The method of adjusting a microwave filter from one sub-band to another sub-band of claim 16, wherein said at least one electrically conductive ring is formed on a printed circuit board.

20. The method of adjusting a microwave filter from one sub-band to another sub-band of claim 16, wherein said at least one electrically conductive ring is suspended in an insulating material.

21. The method of adjusting a microwave filter of claim 16, wherein said RF switch is a mechanical relay.

22. The method of adjusting a microwave filter of claim 16, wherein said RF switch is selected from the group consisting of PIN diodes, MEMS, RF transistors, voltage-tunable capacitor, mechanical relays, mechanical switches and piezo-electric actuator.

23. A method of adjusting a microwave filter from one sub-band to another sub-band comprising the steps of:

placing at least one metallic plate in an upper region of a cavity of a resonator, wherein an RF switch is disposed between each of said at least one metallic plate and ground, and selectively switching said RF switch to electrically connect and disconnect said at least one metallic plate to ground.

24. The method of adjusting a microwave filter from one sub-band to another sub-band of claim 23, wherein said at least one metallic plate comprises a plurality of metallic plates placed in the upper region of said cavity of said resonator, and wherein said plurality of metallic plates are disposed in the same horizontal plane within said upper region of said cavity.

25. The method of adjusting a microwave filter from one sub-band to another sub-band of claim 23, wherein said at least one metallic plate is suspended in an insulating material.

26. The method of adjusting a microwave filter of claim 23, wherein said RF switch is a mechanical relay.

27. The method of adjusting a microwave filter of claim 23, wherein said RF switch is selected from the group consisting of PIN diodes, MEMS, RF transistors, voltage-tunable capacitor, mechanical relays, mechanical switches and piezo-electric actuator.

28. A microwave filter comprising:

a resonator; and an inductance adjusting device, wherein said inductance adjusting device further comprises:

at least one electrically conductive ring disposed around said resonator;

an RF switch corresponding to each of said at least one electrically conductive ring;

wherein each said RF switch is disposed within an electrical path of said corresponding electrically conductive ring;

wherein each said RF switch is operable to electrically open and close each electrical path of said corresponding electrically conductive ring; and wherein said at least one electrically conductive ring is substantially perpendicular to a magnetic field of said resonator.

29. The microwave filter of claim 28, wherein a capacitor is disposed within the electrical path of each said electrically conductive ring.

30. The microwave filter of claim 28, wherein said at least one electrically conductive ring is formed on a printed circuit board.

31. The microwave filter of claim 28, wherein said resonator is a dielectric-loaded resonator.

32. The microwave filter of claim 31, wherein said at least one electrically conductive rings is disposed within an inner cavity of said dielectric-loaded resonator.

33. The microwave filter of claim 28, wherein said at least one electrically conductive ring is suspended in an insulating material.

34. The microwave filter of claim 28, wherein said at least one electrically conductive ring comprises a plurality of concentric electrically conductive rings, each of said plurality of concentric electrically conductive rings having a different diameter.

35. The microwave filter of claim 28, wherein said at least one electrically conductive ring comprises a plurality of non-concentric electrically conductive rings.

36. The microwave filter of claim 28, wherein said RF switch is a mechanical relay.

37. The microwave filter of claim 28, wherein said RF switch is selected from the group consisting of PIN diodes, MEMS, RF transistors, voltage-tunable capacitor, mechanical relays, mechanical switches and piezo-electric actuator.

38. A method of adjusting a microwave filter from one sub-band to another sub-band comprising the steps of:

placing at least one electrically conductive ring around a resonator, wherein an RF switch is disposed within an electrical path of each said electrically conductive ring and ground, and selectively switching said RF switches to electrically open and close each electrical path of said corresponding electrically conductive ring;

wherein said at least one electrically conductive ring is substantially perpendicular to a magnetic field of said resonator.

39. The method of adjusting a microwave filter of claim 38, wherein a capacitor is disposed within the electrical path of each said electrically conductive ring.

40. The method of adjusting a microwave filter of claim 38, wherein said at least one electrically conductive ring is formed on a printed circuit board.

41. The method of adjusting a microwave filter of claim 38, wherein said resonator is a dielectric-loaded resonator.

42. The method of adjusting a microwave filter of claim 41, wherein said at least one electrically conductive rings is disposed within an inner cavity of said dielectric-loaded resonator.

43. The method of adjusting a microwave filter of claim 38, wherein said at least one electrically conductive ring is suspended in an insulating material.

44. The method of adjusting a microwave filter of claim 38, wherein said at least one electrically conductive ring comprises a plurality of concentric electrically conductive rings, each ring having a different diameter.

45. The method of adjusting a microwave filter of claim 38, wherein said at least one electrically conductive ring comprises a plurality of non-concentric electrically conductive rings.

46. The method of adjusting a microwave filter of claim 38, wherein said RF switch is a mechanical relay.

47. The method of adjusting a microwave filter of claim 38, wherein said RF switch is selected from the group consisting of PIN diodes, MEMS, RF transistors, voltage-tunable capacitor, mechanical relays, mechanical switches and piezo-electric actuator.

48. A microwave filter comprising:

a resonator; and an inductance adjusting device, wherein said inductance adjusting device further comprises:

at least one electrically conductive ring disposed around said resonator;

a dielectric rod attached to said at least one electrically conductive ring, wherein said dielectric rod is operable to rotate said at least one electrically conductive ring.

49. The microwave filter of claim 48, wherein said dielectric rod is operable to move said at least one electrically conductive ring relative to said resonator.

50. A method of adjusting a microwave filter from one sub-band to another sub-band comprising the steps of:

placing at least one electrically conductive ring around a resonator, and selectively rotating said at least one electrically conductive ring.

51. The method of adjusting a microwave filter from one sub-band to another sub-band of claim 50 further comprising the step of:

selectively moving said at least one electrically conductive ring relative to said resonator.

52. A method of tuning a communication system comprising the steps of:

providing a base station which includes a microwave filter having an inductance adjusting device; and configuring said base station to be tunable to a desired sub-band by controlling said inductance adjusting device;

wherein computer control signals are used to control said inductance adjusting device; and wherein said base station is tunable from a location remote from said base station.

53. The method of tuning a communication system of claim 52, wherein said inductance adjusting device further comprises:

at least one electrically conductive ring disposed around a resonator;

an RF switch corresponding to each of said at least one electrically conductive ring;

wherein each said RF switch is disposed within an electrical path of said corresponding electrically conductive ring; and wherein each said RF switch is operable to electrically open and close each electrical path of said corresponding electrically conductive ring.

54. A method of tuning a communication system comprising the steps of:

accessing a base station which includes a microwave filter having a capacitance adjusting device; and tuning said base station to a desired sub-band by controlling said capacitance adjusting device;

wherein computer control signals are used to control said capacitance adjusting device; and wherein said tuning is controlled from a location remote from said base station.

55. The method of tuning a communication system of claim 54, wherein said capacitance adjusting device comprises:

at least one electrically conductive ring disposed in an upper region of a cavity of a resonator;

an RF switch corresponding to each of said at least one electrically conductive ring;

wherein each said RF switch is disposed between ground and said corresponding electrically conductive ring; and wherein each said RF switch is operable to electrically connect and disconnect each said corresponding electrically conductive ring to ground.

56. The method of tuning a communication system of claim 54, wherein said capacitance adjusting device comprises:

at least one metallic plate disposed in an upper region of a cavity of a resonator; and an RF switch corresponding to each of said at least one metallic plate;

wherein each RF switch is disposed between ground and said corresponding metallic plate; and wherein each RF switch is operable to electrically connect and disconnect each said corresponding metallic plate to ground.

* * * * *